US005687524A

United States Patent [19]

Ting

[11] Patent Number: 5,687,524

[45] Date of Patent: Nov. 18, 1997

[54] APPARATUS FOR SEALING PANEL JOINTS OF BUILDING SURFACES

[76] Inventor: Raymond M. L. Ting, 318 Holiday Dr., Pittsburgh, Pa. 15237

[21] Appl. No.: 387,416

[22] Filed: Feb. 10, 1995

[51] Int. Cl.[6] ..... E04C 3/00

[52] U.S. Cl. ..... 52/461; 52/235; 52/466; 52/469

[58] Field of Search ..... 52/235, 461, 466, 52/469

[56] References Cited

U.S. PATENT DOCUMENTS

| | | | |
|---|---|---|---|
| 3,062,339 | 11/1962 | Geyser | 52/235 X |
| 3,893,272 | 7/1975 | Plom | 52/235 |
| 4,912,898 | 4/1990 | Holmes | 52/235 |
| 5,088,255 | 2/1992 | Emanuel | 52/461 X |
| 5,220,759 | 6/1993 | Hossli | 52/235 |
| 5,259,162 | 11/1993 | Nicholas | 52/469 X |
| 5,263,292 | 11/1993 | Holland et al. | 52/235 |
| 5,381,637 | 1/1995 | Favag | 52/235 X |
| 5,452,552 | 9/1995 | Ting | 52/235 |

FOREIGN PATENT DOCUMENTS

| | | | |
|---|---|---|---|
| 2075079 | 11/1981 | United Kingdom | 52/461 |
| 2143570 | 2/1985 | United Kingdom | 52/235 |
| 21400 | 10/1993 | WIPO | 52/235 |

*Primary Examiner*—Wynn E. Wood
*Assistant Examiner*—Aimee E. McTigue
*Attorney, Agent, or Firm*—Carol I. Bordas; Noland J. Cheung

[57] ABSTRACT

This invention relates to repairing the water leakage problem of panel joints in an exterior building surface. In addition, this method may also be used to project new panel joints. A long lasting effective repair method is provided by using two extruded component parts assembled in the field to cover up the existing panel joints such that a number of P.E. Cavities and air links are created to form P.E. Seals around the existing panel joints such that elements such as exterior water can no longer reach the leaking joints. Since P.E. Seals can tolerate a significant degree of imperfection without causing the water infiltration problem, the effectiveness of the repair work can be expected to last for a long time.

17 Claims, 7 Drawing Sheets

APPARATUS FOR SEALING PANEL JOINTS OF BUILDING SURFACES

FIELD OF THE INVENTION

This invention relates to a method of repairing panel joint seals to prevent water leakage through the panel joints of exterior building surfaces, including roof and wall surfaces. In addition, this method may also be used to protect new panel joints. In particular, two extruded component parts which are assembled in the field, are utilized to cover up new or existing panel joints such that a number of pressure equalized cavities and air links are created to form pressure equalized seals around the existing panel joints such that exterior water can no longer reach the leaking joints.

DESCRIPTION OF THE PRIOR ART

In modern building construction, the exterior building surfaces are constructed from multiple building panels forming multiple panel joints around each panel. These panel joints are sealed against water infiltration. In most of the existing buildings, the initial panel joint sealing integrity is heavily dependent on perfect field workmanship. Since field quality control is extremely difficult to execute, it is almost impossible to achieve such perfect field workmanship, therefore, repairs are normally required after the building construction has been completed. In addition, the panel joint sealing integrity is dependent on the durability of the sealing material in most of the designs. Since there is no sealing material which will last forever available in the market place, latent sealant failures causing water leakage problems are inevitable. Due to the reasons stated above, frequent panel joint repairs are common practice in the industry.

Another major problem associated with the water leakage problem is the detectability of water leakage in both time and location. Generally, the water leakage problem is discovered only after prolonged water infiltration has already resulted in significant water damage. Examples of such damage are wet-down of the internal insulation material, disintegration of water absorbing panel liner material, panels falling off the building due to the corrosion of the anchoring clips, corrosion of the steel supporting members, and numerous other water damage problems. Once the water leakage problem has been discovered, there are two common problems, namely, locating the source of leakage and accessing the location of the leakage to make repairs. As a result, locating the source of leakage always involves time and procedures which are costly. Since there is much difficulty in accessing the source of leakage for repair, most repairs are done by applying caulking to seal off the joints from outside. Due to the undetectability of the initial water infiltration and the immense cost of late discovery, many building owners have adopted scheduled recaulkings as a necessary policy of maintenance procedure.

SUMMARY OF THE INVENTION

In order to provide a long lasting sealing integrity of a panel joint, it is essential that the sealing integrity of the panel joint, before and after repair, be able to tolerate a significant degree of imperfection in the sealant line without causing water leakage. The objective of this invention is to provide outboard building components to cover up the existing exterior panel joints such that the probability that elements such as water, snow, ultraviolet radiation, hail, animals, etc., will reach the existing panel joints is greatly reduced. In addition, a further object of this invention is to cover up new panel joints from the previously mentioned elements.

In order to explain the working principles of this invention, the following terminologies are defined.

(1) Differential Pressure Seal or D.P. Seal: A sealant line between two air spaces having a significant differential air pressure. The sealant lines bordering the interior air cavity are considered D.P. Seals.

(2) Pressure Equalized Cavity or P.E. Cavity: A wall cavity that allows the exterior air to flow in freely such that the air pressure within the wall cavity can approach the exterior air pressure in a short period of time.

(3) Pressure Equalized Seal or P.E. Seal: A sealant line placed between a P.E. Cavity and the exterior air.

Generally, the combination of the following three elements cause water leakage: 1) water running over the sealant line, 2) imperfections in the sealant line (e.g. hairline cracks or pin holes), and 3) differential air pressure forcing the water to infiltrate through the cracks or holes in the sealant line. The water leakage problem can be solved if one or more, and preferably all, of the above elements can be eliminated.

As previously discussed, imperfections in the sealant line (element No. 2 above) cannot be prevented, therefore, the water leakage problem can only be prevented by first, using the combination of P.E. Seals in the areas subject to the exterior running water and second, by preventing the exterior water from reaching the D.P. Seals. The above principles, as applied to an interlocking curtain wall panel joints, are discussed in my allowed U.S. patent application Ser. No. 08/033,332, which is hereby incorporated by reference.

The objective of the invention is accomplished by utilizing a new joint cover means to cover up the existing panel joints or new panel joints such that new P.E. Cavities and P.E. Seals are created around the panel joint to prevent exterior water from reaching the panel joint. The design functions of the present invention will become apparent in the explanations of the preferred embodiments.

DESCRIPTION OF THE PREFERRED EMBODIMENTS

Figure 1:
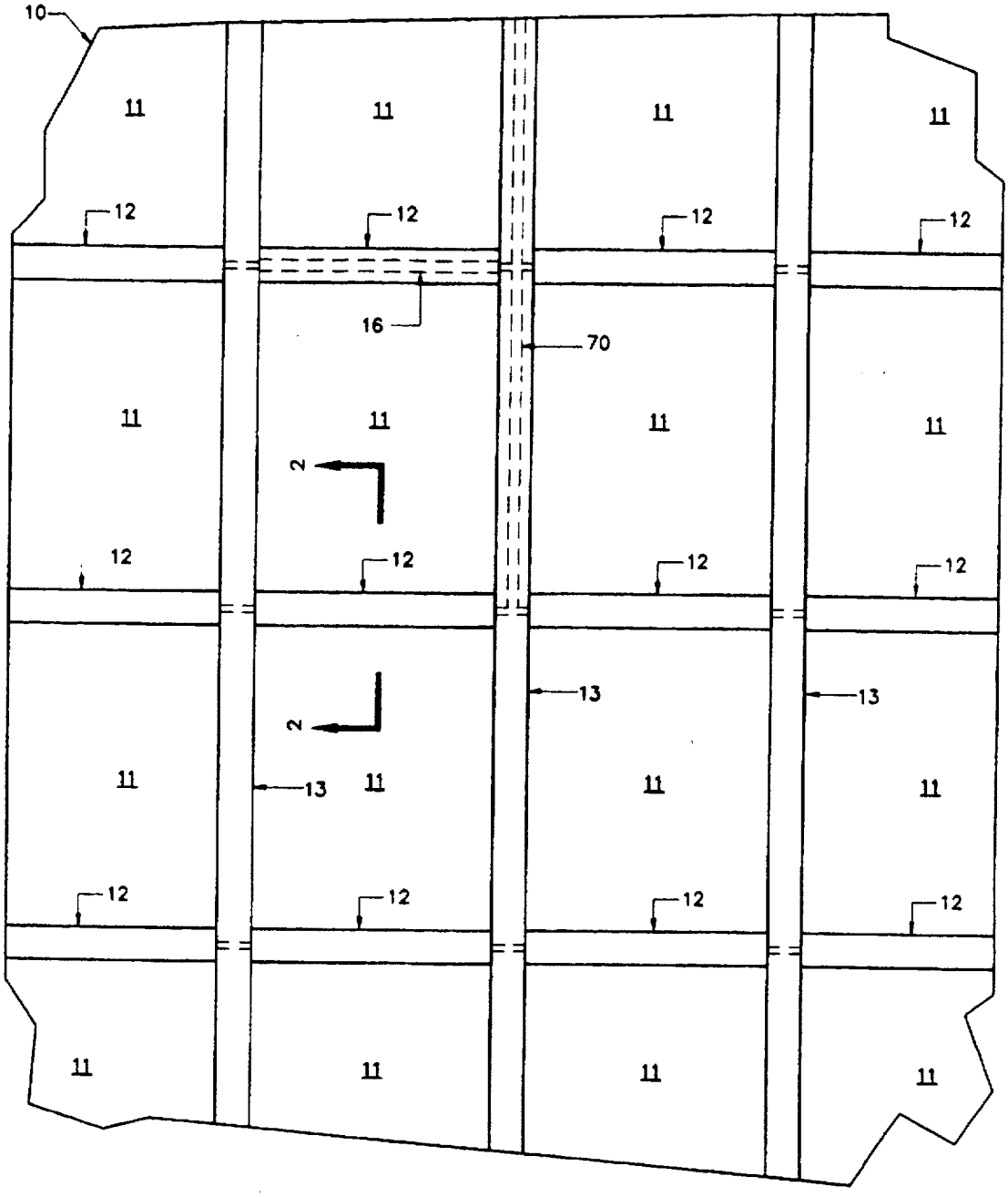
FIG. 1 represents a partial plan view of an exterior building surface utilizing the present invention.

FIG. 1 represents a partial plan view of an exterior building surface 10 incorporating the present invention. The exterior building surface 10 is formed by multiple building panels 11. The horizontal panel joints 16 are covered with the joint covering means 12 of the present invention. The sloping or vertical panel joints 70 are covered with the joint covering means 13 of the present invention.

Figure 2:
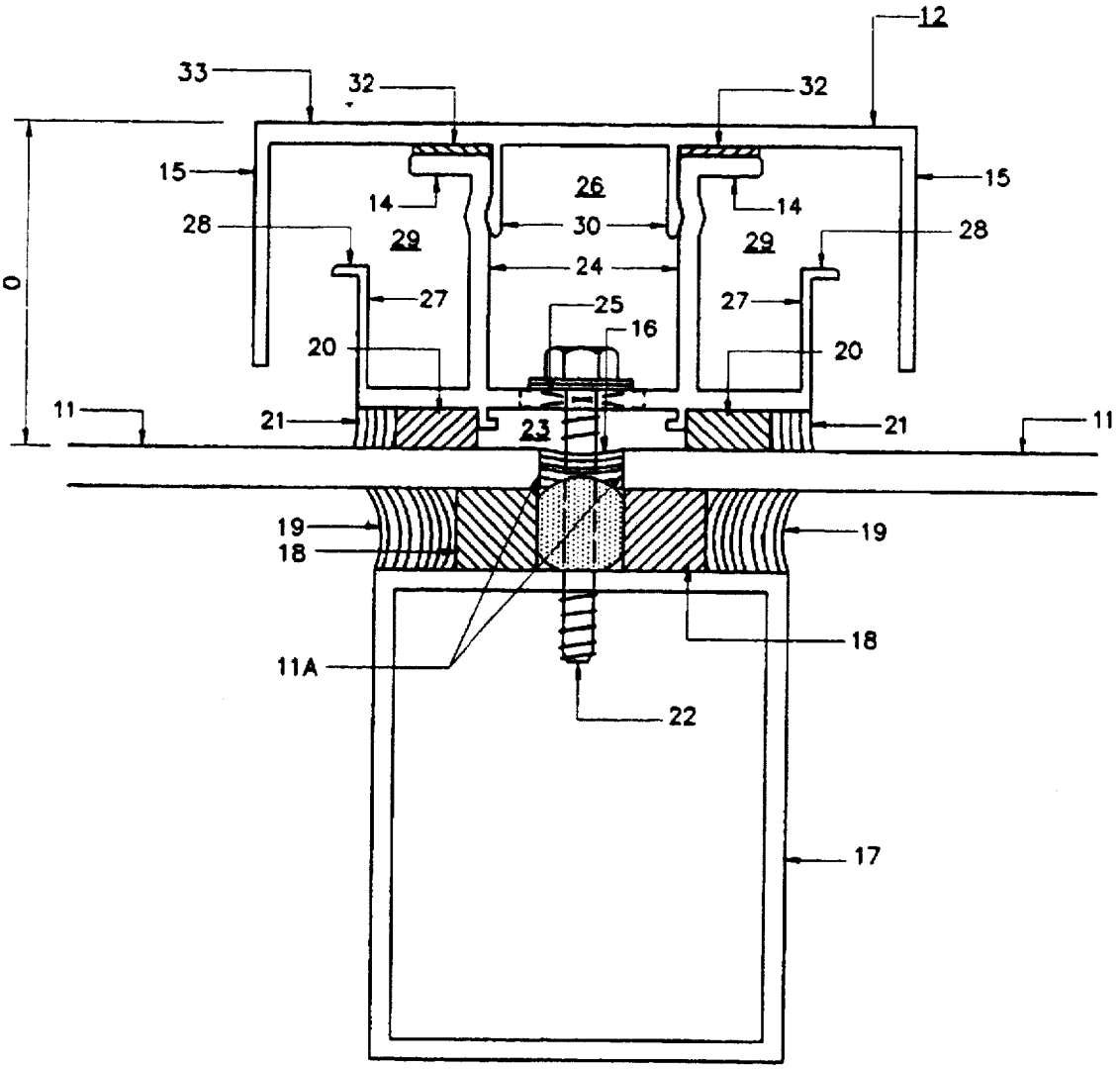
FIG. 2 is a typical fragmentary cross-sectional view taken along line 2—2 of FIG. 1 showing an example of a construction of the panel joint covering means of the present invention which is more desirable for the roof condition.

FIG. 2 shows an example fragmentary cross-section of the horizontal panel joint covering means 12 of the present invention taken along line 2—2 of FIG. 1, which is preferred for the roof condition. The opposing sides 11A of building panels 11 define a gap into which caulking or other material is inserted to create panel joint 16. The building panels 11 are structurally connected to the panel supporting members 17 using spacers 18 and structural caulking 19. The caulked joint 16 represents the leaking panel joint to be repaired by the joint covering means 12 of the present invention.

The existing panel system as shown by the building surface comprising panels 11, joints 16, supporting members 17, spacers 18, and caulking 19 represents one particular example for illustration purposes only. The present invention can also be utilized to cover new panel joints. In addition, the existing panel system may comprise a large number of shapes other than the one shown and are all adaptable to the present invention as long as the joint covering means 12 is profiled to cover the existing panel joint 16.

The joint covering means 12 consists of an inner member 14 and an outer member 15. The installation of the joint covering means 12 involves the following procedures performed in sequence. The inner member 14 is placed over the existing panel joint 16 using a spacer 20 and sealed to the existing panels 11 with caulking 21 on each side of the existing panel joint 16 such that a space 23 above the existing panel joint 16 and under the inner member 14 is formed. Preferably, the spacer 20 may comprise a double-sided adhesive tape having adequate adhesive strength to hold the inner member in position during the installation and while the caulking 21 is curing. Alternatively, the inner member 14 can be secured in position by the addition of spaced apart screws 22.

After installation of the inner member 14, the outer member 15 is then structurally connected to the inner member 14 in a snap-on fashion utilizing fins 30 which snap-on to the upstanding legs 24 as shown in FIG. 2. There are, however, many possible other "snap-on" structural connection means between the inner member 14 and the outer member 15 that can be utilized in the present invention. Furthermore, the outer member 15 can also be structurally connected to the inner member 14 with connection means other than a "snap-on" means. For example, the outer member 15 may be fastened to the inner member 14 through the use of clips, staples, screws, nails, adhesives, etc. The inner member 14 has two upstanding legs 24 forming an upwardly open cavity 26 positioned above the space 23. Spaced apart pressure equalization holes 25 are provided along the bottom of the inner member 14 to interconnect the space 23 in gas flow communication with the cavity 26. In addition, member 14 preferably comprises outer upstanding legs 27 to further deflect water.

As shown in FIG. 2, the cavities 29 are in free gas flow communication to the outside air and thus, are P.E. Cavities. As later explained with respect to FIG. 5, the air space in cavity 26 is interconnected to the air spaces in the cavities 29 at the ends of inner member 14. As a result, the space 23 becomes a P.E. Cavity through the air links described above. Spaced apart spacers 32, which are optional can be provided to further enhance the air link between cavity 26 and cavities 29. Consequently, the sealant lines 21 become P.E. Seals which can be subjected to running water while tolerating imperfections in the sealant lines 21 without causing water infiltration. The existing panel joint seal 16 is a D.P. Seal.

The objective of the present invention is to prevent the exterior water from reaching the existing panel joint seal 16 and is further explained in the following description of the water path behavior on the wall of the building. The exterior water running down along the exterior surface of a vertical or sloped panel 11 will come in contact with the sealant line 21 on the upper side thereof and flow across to the sloping or vertical joints at the ends of member 14 where drainage gaps 31 (shown on FIG. 4) are present for allowing the water to flow downwardly pass the horizontal joint covering means 12. If the expected quantity of water flow is relatively large, the optional legs 27 with the water diverting tips 28 would be desirable. In this arrangement, most of the water will be flowing outside of leg 27 and any water overflowing past legs 27 and tips 28 will be collected within cavity 29 and flow towards the ends of members 14 for eventual downward drainage. Since the existing panel joint sealant line 16 which is a D.P. Seal is protected by a P.E. Seal 21, the exterior water will not be able to reach the sealant line 16 and the objective of the present invention is accomplished.

The particular profile arrangement as shown is more desirable for a sloped or horizontal roof condition where the depth D (shown in FIG. 2) of the joint covering means 12 is about 1.5 inches (38.1 mm) to accommodate possible accumulation of roof water and the width of the top flat surface 33 of the outer member 15 is about 4 inches (101.6 mm) to allow people to walk on the outer member for maintenance work. To enhance the safety of walking, a nonskid membrane (not shown) can be glued to the top flat surface 33. The inner member 14 and the outer member 15 are preferably made of extruded aluminum or PVC or other suitable extrudable material. It must be noted that in the repaired joint, all sealant lines are shaded from the sunlight during most daylight hours, thus, the degradation of the sealant material due to the effect of the ultraviolet light is virtually eliminated. It must also be noted that since the sealant line 21 is a P.E. Seal, gasket types of material can be substituted for the caulking sealant line 21.

Figure 2A:
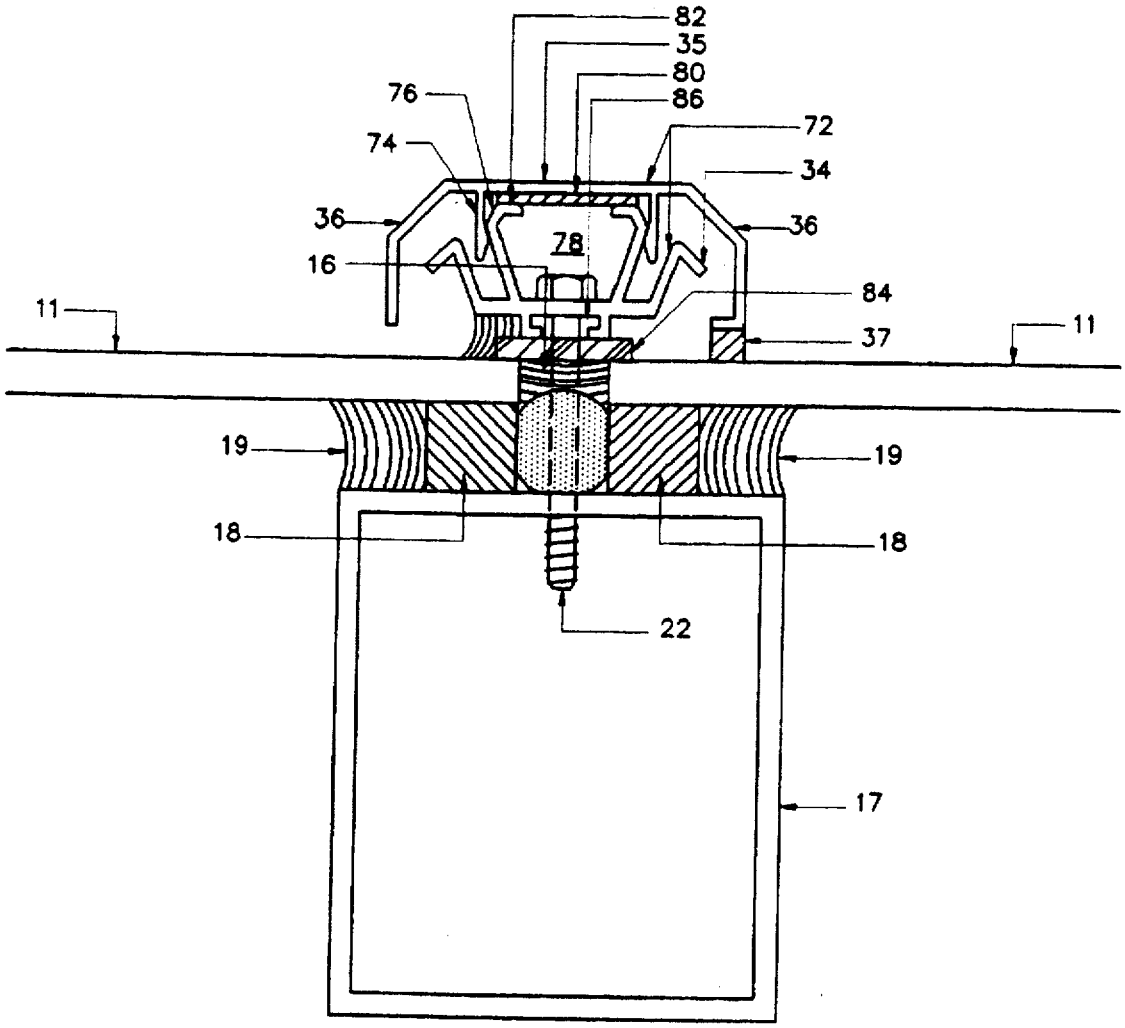
FIG. 2*a* is a variation of FIG. 2 showing an example construction of the panel joint covering means of the present invention which is more desirable for the wall condition.

FIG. 2*a* is a variation of FIG. 2 in which the size of the panel joint covering means 72 is minimized and more desirable in a vertical wall condition where the member strength requirement is reduced and the aesthetic requirement is increased. The inner joint covering member 34 can be reduced to about 0.75 inch (19 mm) in depth and about 1.5 inch (38.1 mm) in width. The outer joint covering member 35 can be reduced to about 2 inches (50.8 mm) in width incorporating tapered surfaces 36 to enhance the aesthetic appearance. An additional optional sealant 37 may be used on the upper side of outer joint covering member 35 to divert the water to flow over outer joint covering member 35. In this variation, the snap-on fins 74 snap on to the outside of the upstanding legs 76 of the inner joint covering member 34. To reduce the volume of cavity 78, spacers 80 of varying widths may be disposed between the upstanding leg ends 82 and the outer joint covering member 34. In addition, a spacer 84 of varying widths may be disposed over the length of panel joint 16 to reduce the volume of cavity 86 formed above panel joint 16 and under inner joint covering member 34. The other functional behaviors are the same as explained in FIG. 2. Of course, within the concept of the present invention, an infinite number of profile combinations are contemplated.

Figure 3:
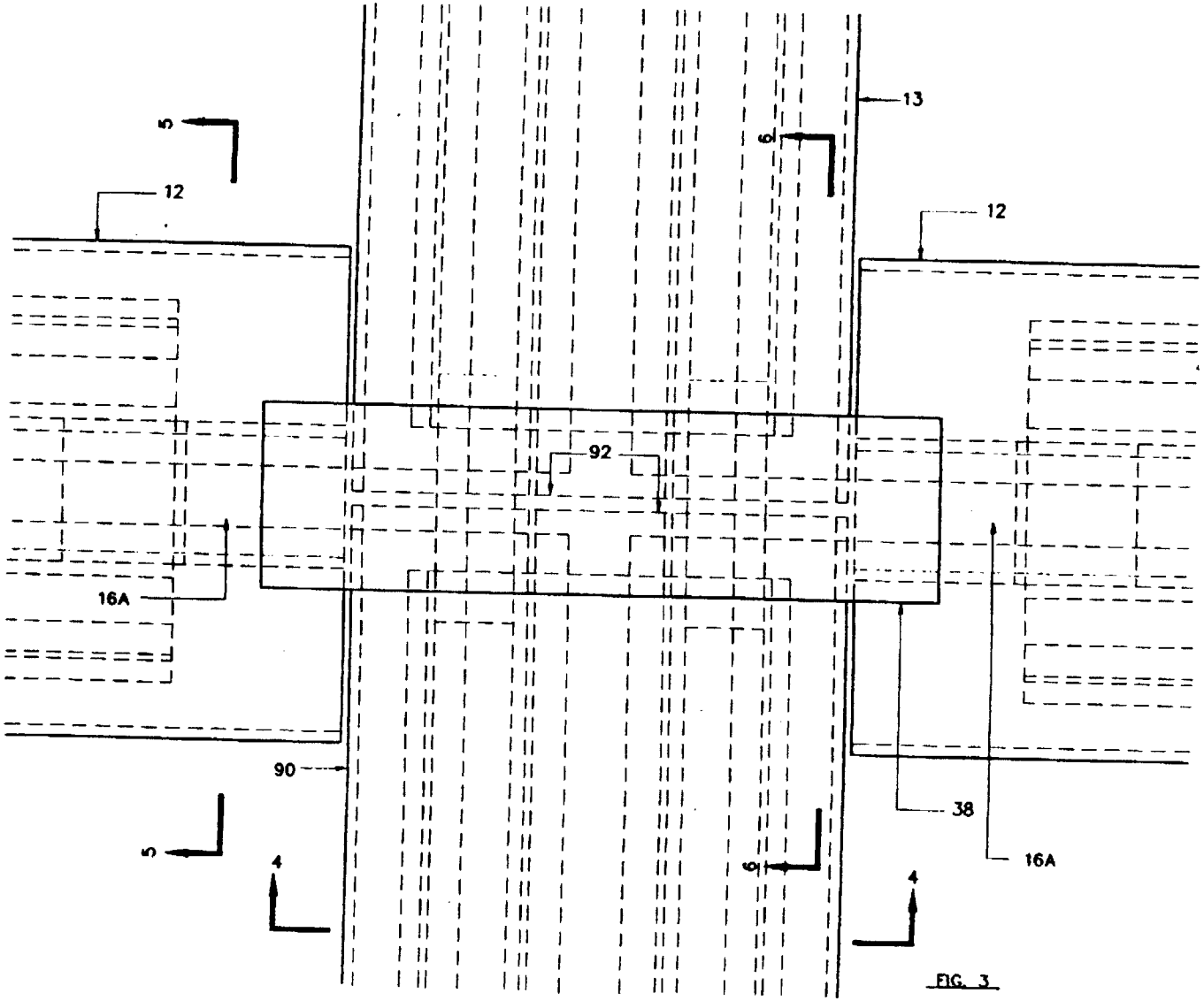
FIG. 3 represents a typical top view of the joint covering means of the present invention at the four corner intersection.

FIG. 3 shows the plan view of the joint covering means of the present invention at the four corner intersection 90.

The horizontal joint covering means 12 terminates at the side of the sloping or vertical joint covering means 13 which may terminate near the midwidth of the horizontal joint covering means 12. The butt joint 92 of the vertical joint covering means 13 is then covered by a butt joint membrane 38 capable of sustaining thermal movements without failure. To minimize the joint repair cost, the same cross-sectional profiles can be used for covering means 12 and 13 even though it is not necessary for such profiles to be the same to function in accordance with the teachings of the present invention.

Figure 4:
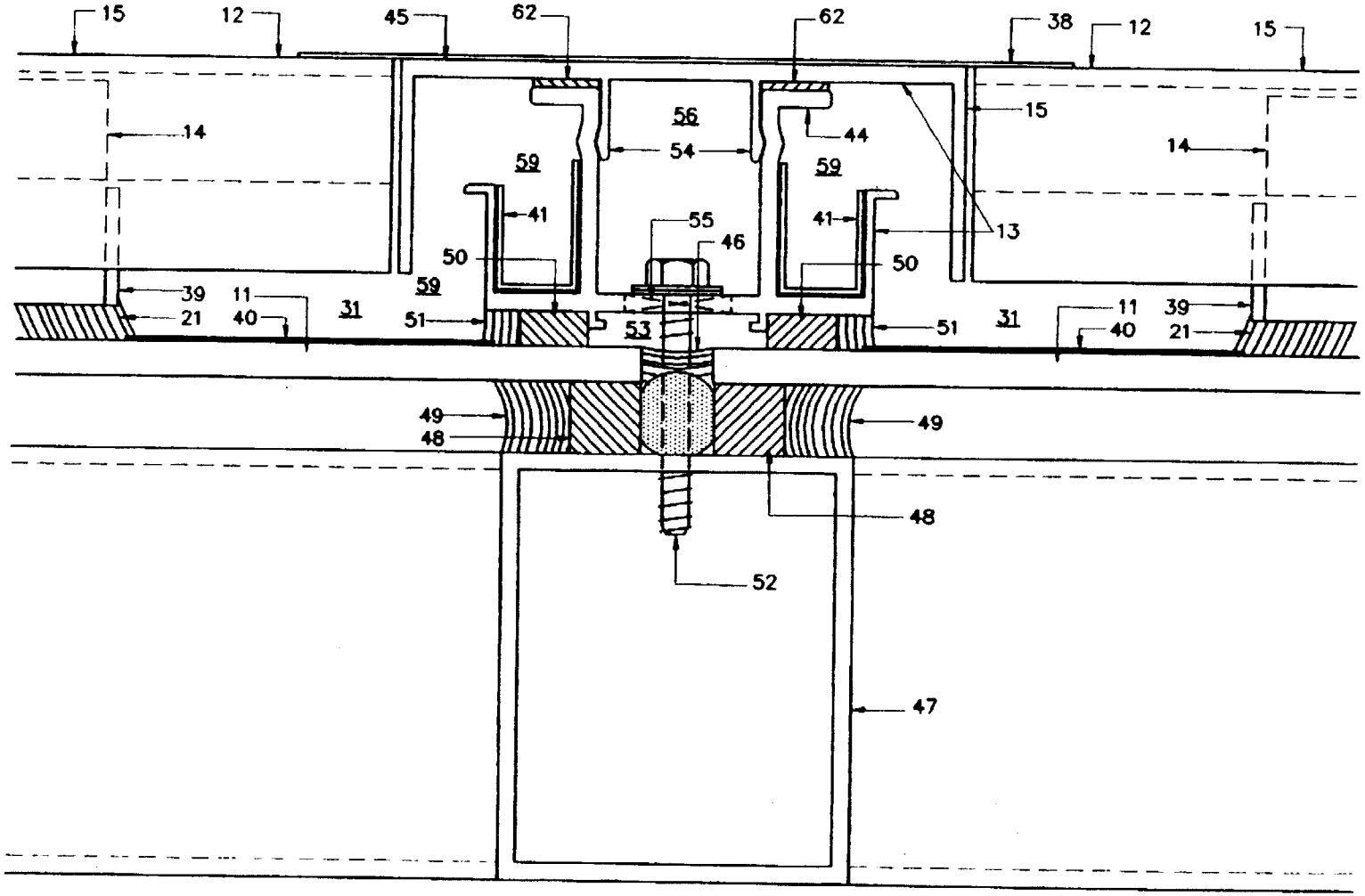
FIG. 4 is a typical fragmentary cross-sectional view taken along line 4—4 of FIG. 3 showing the details at the four corner intersection of an example of the present invention which is more desirable for the roof condition.

FIG. 4 shows an example fragmentary cross-section taken along line 4—4 of FIG. 3 where the same cross-sectional profiles are used in both the horizontal joint covering means 12 and the sloping or vertical joint covering means 13. The building panels 11 define a gap into which caulking or other suitable material is inserted to create a sloping or vertical panel joint 46. The panels 11 are structurally connected to the panel supporting members 47 using spacers 48 and structural caulking 49. The caulked joint 46 represents the leaking panel joint to be covered by the joint covering means 13 of the present invention.

The existing panel system as shown by the building surface comprising elements panel 11, vertical panel joint 46, supporting members 47, spacers 48, and structural caulking 49 represents one particular example for illustration purposes only. The present invention can also be utilized to cover new panel joints. In addition, the existing panel system may comprise a large number of shapes other than the one shown and are all adaptable to the present invention as long as the joint covering means 13 is profiled to cover the existing panel joint 46.

The joint covering means 13 comprises an inner member 44 defining spaced apart pressure equalization holes 55 and an outer member 45. The installation of the joint covering means 13 involves the following procedures performed in sequence. The inner member 44 is placed over the existing joint 46 using a spacer 50 and sealed to the existing panels 11 with caulking 51 on each side of the existing panel joint 46 such that a space 53 above the existing panel joint 46 and under the inner member 44 is formed.

After installation of the inner member 44, the outer member 45 is then structurally connected to the inner member 44 in a snap-on fashion.

Figure 6:
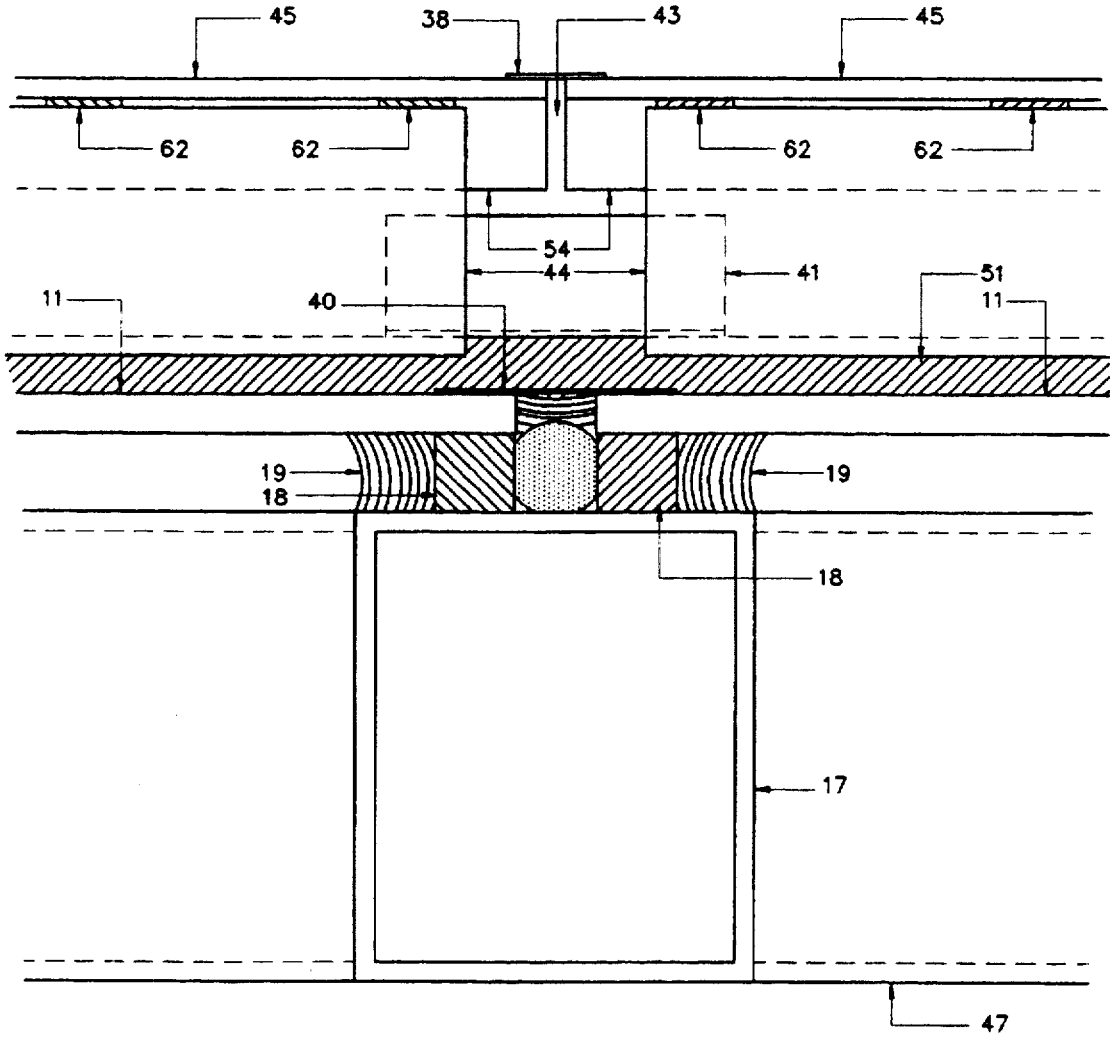
FIG. 6 is a typical fragmentary cross-sectional view taken along line 6—6 of FIG. 3 showing the spliced joint details of the sloping or vertical joint cover.

As shown in FIG. 4, the inner member 44 defines a central cavity 56 and two side cavities 59. It is apparent that the side cavities 59 are in gas-flow communication with the outside air. The air link via air gap between the side cavities 59 and central cavity 56 is provided at the butt joint area as shown in FIGS. 3 and 6. Similar to the principles explained with respect to FIG. 2, the cavities 53, 56, and 59 are P.E. Cavities. Optional spaced apart spacers 62 can be provided to further enhance the air link between central cavities 56 and side cavities 59. Similar to the functional behaviors explained in FIG. 2, the existing panel joint 46 is protected by the sealant lines 51 which become P.E. Seals.

The water drainage path is further explained as follows. The outer horizontal joint covering member 15 terminates near the outer sloping or vertical joint covering member 45. The inner horizontal joint covering member 14 terminates at a distance away from member 45 such that a drainage gap 31 is created. An end closure clip 39 is provided at the end of member 14 to close off the bottom part of the cavity 26 shown more clearly in FIG. 5. The exterior water running down along the surface of panel 11 will come in contact with the horizontal sealant line 21 and will flow horizontally to the drainage gap 31 for downward drainage. In order to prevent the draining water from running over the small segments 16A of the original horizontal panel joint 16 between the ends of members 14 and the sides of members 44, elastic membranes 40 are installed to cover segments 16A of the panel joints 16. The membranes 40 are preferably sealed using adhesives, or other suitable materials to the panels 11 on both sides of the panel joints 16. At the butt joint of members 44, an elastic connector 41 is provided to connect the side cavities 59 provide uninterrupted drainage of incidental water splashed into the side cavities 59. The connectors 41 are of sufficient length to allow for thermal expansion or contraction of members 44. At the butt joint of member 45, an elastic membrane 38 is also provided to cover the butt joint gap 43. Preferably, an extruded silicone pad is used for the elastic membranes 38 and 40. In the case of roof applications, the horizontal joint covering means 12 naturally becomes an ice stopper in preventing ice from sliding off the roof.

Figure 5:
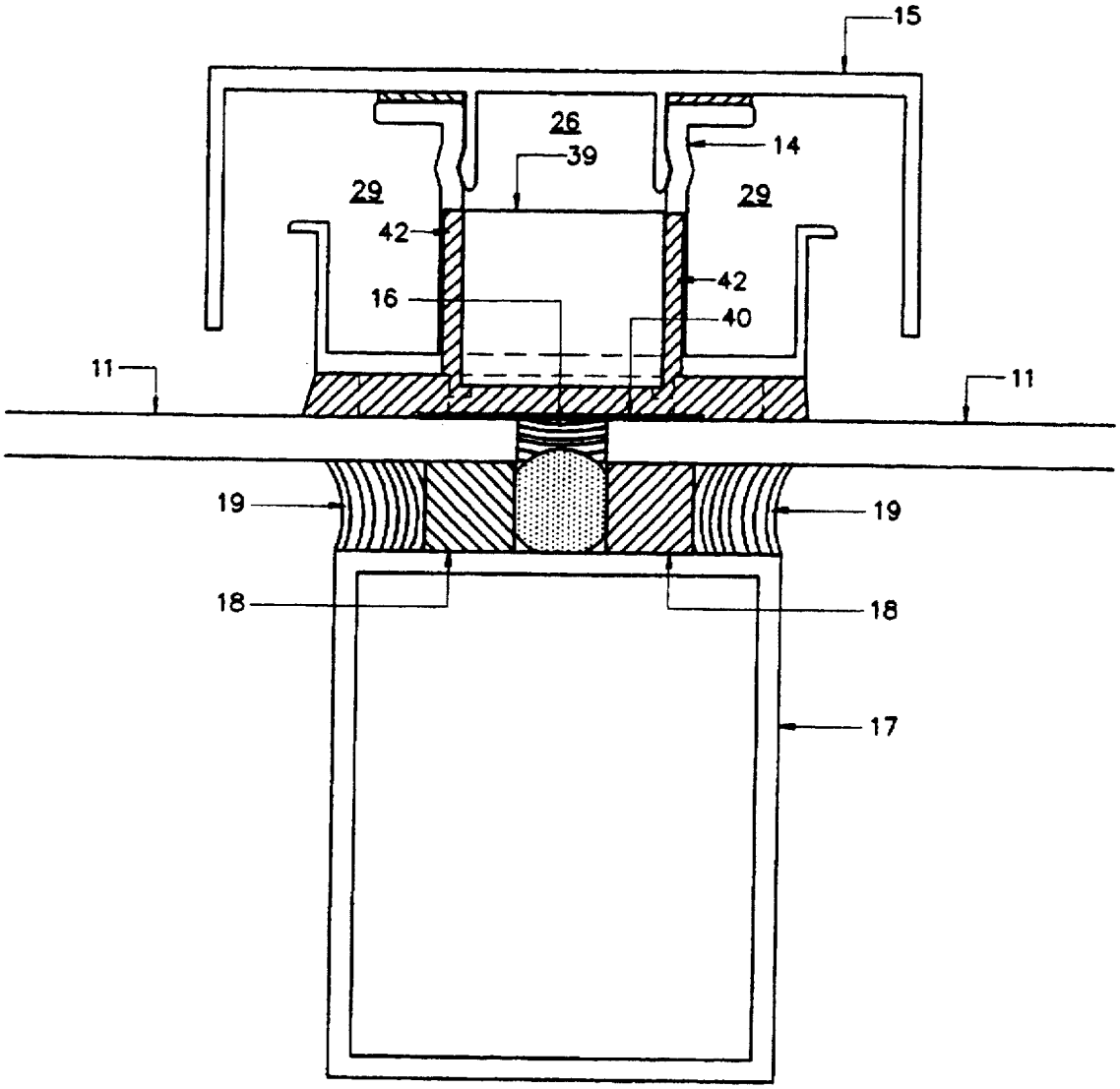
FIG. 5 is a typical fragmentary cross-sectional view taken along line 5—5 of FIG. 3 showing the end of the horizontal joint cover which is compatible with the system shown in FIG. 4.

FIG. 5 shows an example fragmentary cross-section taken along line 5—5 of FIG. 3. The end closure clip 39 is sealed onto legs of member 14 using caulking 42 while the top part of the cavity 26 remains open so that cavity 26 remains in air flow communications with side cavities 29. The elastic membrane 40 is installed in the area of the drainage gap 31 (shown on FIG. 4) to bridge over segment 16A of the existing panel joint 16. Preferably, the membrane 40 is sealed using adhesives to the surfaces of panels 11 on both sides of joint 16. The ends of the side cavities 29 are not closed so that the incidental water splashed into the side troughs 29 will be discharged into the drainage gap 31.

FIG. 6 is the fragmentary cross-sectional view taken along line 6—6 of FIG. 3. The ends of members 45 are spaced apart a small distance near the center of the existing panel joint 16. In addition, the ends of the members 44 are spaced apart at a larger distance and the side cavities 59 (FIG. 4) are spliced with the elastic connectors 41 which are sealed with caulking to panels 11 to make the sealant line 51 continuous. In this arrangement, an air gap 43 is formed between the ends of members 45 and between members 45 and connectors 41 to allow the pressure equalization of the central cavity 56 (FIG. 4). To allow more air link to the central cavity 56, the snap-on fins 54 may be notched at the butting ends.

In summary, the present invention utilizes two component parts assembled in the field to cover up the existing leaking panel joints or new panel joints of an exterior building surface. The major portion of the panel joint is protected by new enclosing P.E. Seals created by a number of P.E. Cavities and air links. A pathway for the water drainage is provided at the four corner intersection of the joint cover. In addition, a small segment of the horizontal joint in the water drainage path is shielded by a sealed elastic membrane. The sealant lines installed in the process are shaded from the sunlight, thus, the degradation of the sealant material due to the exposure of ultra-violet light is prevented. Since P.E. Seals can tolerate a significant degree of imperfection without causing water leakage problem, the repair work for an existing panel joint will be effective for a much longer period of time than the conventional method of repair.

While I have illustrated and described several embodiments of my invention, it will be understood that these are by way of illustration only and that various changes and modifications may be contemplated in my invention and within the scope of the following claims.

I claim:

1. An apparatus covering intersections of plurality of panel joint seals located between a plurality of panels on a building structure, each of said panels having an interior side and an exterior side to prevent from said structure's exterior to said structure's interior, said apparatus comprising:

(a) a plurality of vertical joint covering members, each of said vertical joint covering members having first and second ends, and covering a length of one of said plurality of vertical panel joint seals to form a first pressure-equalized cavity between said vertical joint covering member and said vertical panel joint seal;

(b) a plurality of horizontal joint covering members, each of said horizontal joint covering members having first and second ends and covering a length of one of said plurality of horizontal panel joint seals to form a second pressurized-equalized cavity between said horizontal joint covering member and one of said horizontal panel joint seal;

(c) means for fastening each of said horizontal joint covering members to said exterior side of each said panels bordering one of said plurality of horizontal panel joint seals covered thereby;

(d) means for fastening each of said vertical joint covering members to said exterior side of each said panels bordering said vertical panel joint seal covered thereby; and (e) means for connecting said horizontal joint covering members and said vertical joint covering members converging at said intersection.

2. An apparatus according to claim 1, wherein each of said vertical joint covering members comprises:

(a) an inner member traversing the length of said vertical panel joint seal to define said first pressure-equalized cavity exterior said length of said vertical panel joint seal and between said inner member, whereby an air pressure in said first cavity approximates an exterior air pressure acting on said structure;

(b) an outer member disposed on said inner member and forming an outer pressure equalized cavity between said outer member and said inner member; and (c) means for fastening said inner member to said exterior side of each said panels, said outer member and said inner member acting to cover said length of said vertical panel joint seal.

3. An apparatus according to claim 2, wherein said outer member of each said vertical joint covering members is fastened to said inner member of each of said vertical joint covering members by a snap on means.

4. An apparatus according to claim 2 wherein the apparatus comprises a means for allowing air to enter of said cavities.

5. An apparatus according to claim 4, wherein said means for allowing air to enter each of said cavities are provided by pressure equalization holes in said inner member.

6. An apparatus according to claim 2, wherein said inner member of said vertical joint covering members is an extrusion.

7. An apparatus according to claim 6, wherein said extrusion is an extruded PVC member.

8. A apparatus according to claim 6, wherein said extrusion is an aluminum extrusion.

9. An apparatus according to claim 1, wherein said horizontal joint covering member comprises (a) an inner member traversing the length of said horizontal panel joint seal to define said second pressure-equalized cavity exterior said length of said horizontal panel joint seal and between said inner member, whereby an air pressure in said second cavity approximates an exterior air pressure acting on said structure;

(b) an outer member disposed on said inner member and forming an outer pressure equalized cavity between said outer member and said inner member; and (c) means for fastening said inner member to said exterior side of each said panels, said outer member and said inner member acting to cover said length of said horizontal panel joint seal.

10. An apparatus according to claim 9, wherein said inner member of said horizontal joint covering members is an extrusion.

11. An apparatus according to claim 10, wherein said extrusion is an extruded PVC member.

12. An apparatus according to claim 10, wherein said extrusion is an aluminum extrusion.

13. An apparatus according to claim 9, wherein said outer member of each of said horizontal joint covering members is fastened to said inner member of each of said horizontal joint covering members by a snap-on means.

14. An apparatus according to claim 9, wherein the apparatus comprises a means for allowing air to enter each of said cavities.

15. An apparatus according to claim 14, wherein said means for allowing air to enter each of said cavities are provided by pressure equalization holes in said inner member.

16. An apparatus according to claim 1, wherein said means for fastening each of said horizontal joint covering members to each of said vertical joint covering members is a butt joint membrane.

17. An apparatus according to claim 1, wherein said means for fastening each of said horizontal joint covering members and each of said vertical joint covering members to the exterior sides of each said panels is a double-sided adhesive tape.

* * * * *